US008191290B2

(12) United States Patent
Hughes, IV et al.

(10) Patent No.: US 8,191,290 B2
(45) Date of Patent: Jun. 5, 2012

(54) DISPLACEMENT-CONTROLLED HYDRAULIC SYSTEM FOR MULTI-FUNCTION MACHINES

(75) Inventors: Edward C. Hughes, IV, Fort Wayne, IN (US); Christopher Alan Williamson, West Lafayette, IN (US); Joshua D. Zimmerman, Lafayette, IN (US); Monika Marianne Ivantysynova, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 223 days.

(21) Appl. No.: 12/612,969

(22) Filed: Nov. 5, 2009

(65) Prior Publication Data

US 2010/0162593 A1 Jul. 1, 2010

Related U.S. Application Data

(60) Provisional application No. 61/111,752, filed on Nov. 6, 2008.

(51) Int. Cl.
*E02F 3/43* (2006.01)

(52) U.S. Cl. ..... 37/348

(58) Field of Classification Search ..... 37/347, 37/348, 466, 468; 172/2–11, 779, 818–821; 414/697–724; 60/464, 473, 475, 423, 420, 60/486, 450, 452, 444
See application file for complete search history.

(56) References Cited

U.S. PATENT DOCUMENTS 4,561,824 A * 12/1985 Okabe et al. ..... 414/697
5,048,293 A * 9/1991 Aoyagi ..... 60/420
5,329,767 A 7/1994 Hewett
5,622,226 A * 4/1997 Hausman et al. ..... 172/4.5
6,481,202 B1 * 11/2002 Zuehlke et al. ..... 60/464
7,543,449 B2 6/2009 Ivantysynova et al.
7,942,208 B2 * 5/2011 Hughes et al. ..... 172/4.5
2007/0283688 A1 12/2007 Vigholm et al.

FOREIGN PATENT DOCUMENTS

| | | |
|---|---|---|
| DE | 10303360 | 8/2004 |
| JP | 2005-119619 | 5/2005 |
| JP | 2005-297815 | 10/2005 |
| WO | 2004067969 | 8/2004 |

OTHER PUBLICATIONS

Zimmerman and Ivantysynova; The Effect of System Pressure Level on the energy Consumption of Displacement Controlled Actuator Systems; Published at Conference in Krakou, Poland, Jul. 2008.
Williamson, Zimmerman, Ivantysynova; Efficiency Study of an Excavator Hydraulic System Based on Displacement-Controlled Actuators; Published at Conference in Bath, UK, Sep. 2008.

* cited by examiner

*Primary Examiner* — Robert Pezzuto
(74) *Attorney, Agent, or Firm* — Hartman & Hartman; Gary M. Hartman; Domenica N. S. Hartman

(57) ABSTRACT

A displacement-controlled hydraulic system for installation on a multi-function machine, and multi-function machines equipped with the hydraulic system and having devices for propelling the machine, at least a first implement, and multiple actuators that perform multiple functions of the machine. The multiple actuators include first actuators that control the first implement and second actuators that control the propelling devices. The hydraulic system comprises multiple pumps for controlling the first actuators and optionally the second actuators, and valves that enable at least one of the pumps to sequentially control two of the multiple actuators and a corresponding two functions of the multiple functions performed thereby. None of the pumps sequentially controls the second actuators in combination with any of the first actuators.

28 Claims, 2 Drawing Sheets

DISPLACEMENT-CONTROLLED HYDRAULIC SYSTEM FOR MULTI-FUNCTION MACHINES

CROSS REFERENCE TO RELATED APPLICATIONS

This application claims the benefit of U.S. Provisional Application No. 61/111,752, filed Nov. 6, 2008, the contents of which are incorporated herein by reference.

BACKGROUND OF THE INVENTION

The present invention generally relates to machines having multiple functions performed by hydraulic circuits. More particularly, this invention relates to a displacement-controlled (DC) hydraulic system for use on multi-function machines with earthmoving implements whose movements are performed by rotary and linear actuators.

Compact excavators, wheel loaders and skid-steer loaders are examples of multi-function machines whose operations involve controlling movements of various implements of the machines. FIG. 1 illustrates a compact excavator 100 as having a cab 101 mounted on top of an undercarriage 102 via a swing bearing (not shown) or other suitable device. The undercarriage 102 includes tracks 103 and associated drive components, such as drive sprockets, rollers, idlers, etc. The excavator 100 is further equipped with a blade 104 and an articulating mechanical arm 105 comprising a boom 106, a stick 107, and an attachment 108 represented as a bucket, though it should be understood that a variety of different attachments could be mounted to the arm 105. The functions of the excavator 100 include the motions of the boom 106, stick 107 and bucket 108, the offset of the arm 105 during excavation operations with the bucket 108, the motion of the blade 104 during grading operations, the swing motion for rotating the cab 101, and the left and right travel motions of the tracks 103 during movement of the excavator 100. In the case of a compact excavator 100 of the type represented in FIG. 1, the blade 104, boom 106, stick 107, bucket 108 and offset functions are typically powered with linear actuators 20-25 (represented as hydraulic cylinders in FIG. 1), while the travel and swing functions are typically powered with rotary hydraulic motors (not shown in FIG. 1).

On conventional excavators, the control of these functions is accomplished by means of directional control valves. However, throttling flow through control valves is known to waste energy. In some current machines, the rotary functions (rotary hydraulic drive motors for the tracks 103 and rotary hydraulic swing motor for the cabin 101) are realized using displacement control (DC) systems, which notably exhibit lower power losses and allow energy recovery. In contrast, the position and velocity of the linear actuators 20-25 for the blade 104, boom 106, stick 107, bucket 108, and offset functions typically remain controlled with directional control valves. It is also possible to control linear hydraulic actuators directly with hydraulic pumps. Several pump-controlled configurations are known, using both constant and variable displacement pumps. Displacement control of linear actuators with single rod cylinders has been described in U.S. Pat. No. 5,329,767 and German Patents DE000010303360A1, EP000001588057A1 and WO002004067969, and offers the possibility of large reductions in energy requirements for hydraulic actuation systems. Other aspects of using displacement control systems can be better appreciated from further reference to Zimmerman et al., "The Effect of System Pressure Level on the Energy Consumption of Displacement Controlled Actuator Systems," Proc. of the 5th FPNI PhD Symposium, Cracow, Poland, 77-92 (2008), and Williamson et al., "Efficiency Study of an Excavator Hydraulic System Based on Displacement-Controlled Actuators," Bath ASME Symposium on Fluid Power and Motion Control (FPMC2008), 291-307 (2008), whose contents are incorporated herein by reference.

BRIEF DESCRIPTION OF THE INVENTION

The present invention provides a displacement-controlled hydraulic system for installation on a multi-function machine, and multi-function machines equipped with the hydraulic system.

According to a first aspect of the invention, a displacement-controlled hydraulic system is installed on a multi-function machine having means for propelling the machine, at least a first implement, and multiple actuators that perform multiple functions of the machine. The multiple actuators comprise first actuators that control the first implement and second actuators that control the propelling means of the machine. The hydraulic system comprises multiple pumps for controlling the first actuators and optionally for controlling the second actuators, and valve means for enabling at least one of the pumps to sequentially control two of the multiple actuators and a corresponding two functions of the multiple functions performed thereby, wherein none of the pumps sequentially controls the second actuators in combination with any of the first actuators.

According to a second aspect of the invention, a displacement-controlled hydraulic system adapted for installation on a multi-function machine comprises first and second travel actuators for propelling the machine, a plurality of function actuators for performing other functions of the machine, and a plurality of pumps. The first and second travel actuators are associated with oppositely-disposed first and second sides, respectively, of the machine. The plurality of pumps includes a first pump dedicated for powering the first travel actuator, a second pump dedicated for powering the second travel actuator, and multiple pumps for powering the function actuators. At least one of the multiple pumps for powering the function actuators is controllable for powering two or more of the function actuators.

Another aspect of the invention is a multi-function machine, and particularly an excavator, equipped with a displacement-controlled hydraulic system. The excavator comprises means for propelling the excavator, at least a first earthmoving implement, multiple actuators that perform multiple functions of the excavator, a system for controlling and actuating the multiple actuators. The multiple actuators comprise first actuators that control the first earthmoving implement and second actuators that control the propelling means of the excavator. The system comprises multiple pumps for controlling the first actuators and optionally for controlling the second actuators. The excavator further comprises valve means for enabling at least one of the pumps to sequentially control two of the multiple actuators and a corresponding two functions of the multiple functions performed thereby, wherein none of the pumps sequentially controls the second actuators in combination with any of the first actuators.

In view of the above, it can be seen that a significant advantage of this invention is the capability of switching between outputs of individual pumps to sequentially control multiple different machine functions of a multi-function machine, with the result that the machine is capable of using pumps in numbers less than the number of multiple functions of the machine.

Other aspects and advantages of this invention will be better appreciated from the following detailed description.

DETAILED DESCRIPTION OF THE INVENTION

The present invention provides a displacement-controlled (DC) hydraulic system for use on multi-function machines with implements whose movements are performed by rotary and linear actuators. An example is the excavator 100 represented in FIG. 1, which was previously described as equipped multiple actuators that perform multiple functions of the excavator 100, including propulsion of the excavator 100 and movement of its multiple earthmoving implements 104-108. A nonlimiting commercial example of the excavator 100 is the Bobcat® 435 compact excavator manufactured by the Bobcat Company. While the invention will be discussed with specific reference to the excavator 100 of FIG. 1, it should be understood that the invention is generally applicable to multi-function machines, including other types of excavators as well as wheel loaders and skid-steer loaders.

In conventional displacement-controlled circuits, a separate pump is required to individually control each actuator (which may be a rotary or linear hydraulic motor or actuator), and each actuator would perform a single function of the excavator 100. The invention provides "switching" the output of individual pumps to sequentially control two different machine functions, with the result that the excavator 100 is able to use pumps in numbers less than the number of multiple functions of the excavator 100. In a particular example illustrated in FIG. 2, six pumps can be installed and used to control rotary and/or linear actuators that perform eight different functions, including drive motors for the excavator 100.

Figure 1:
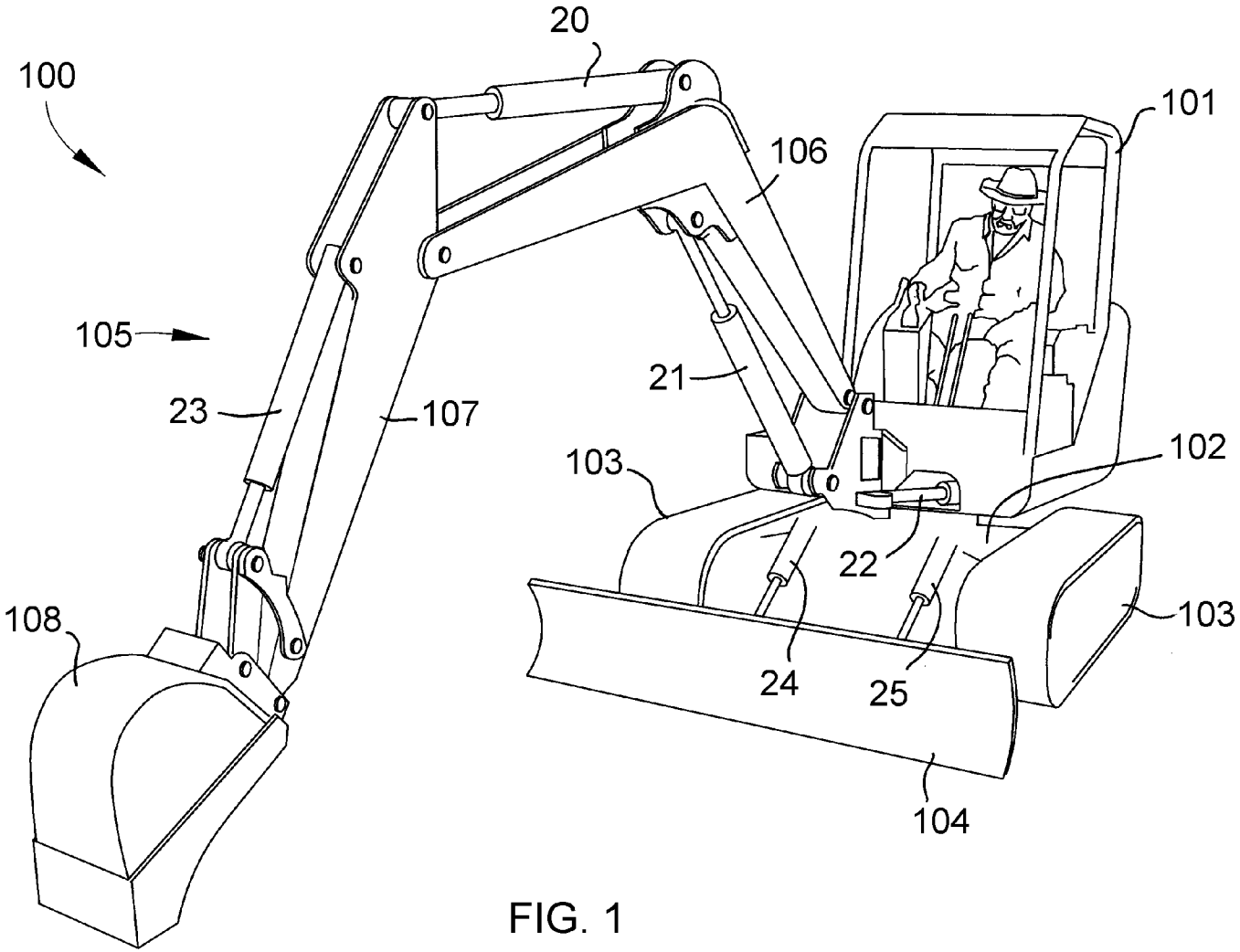
FIG. 1 schematically represents a compact excavator of a type known in the prior art.
Figure 2:
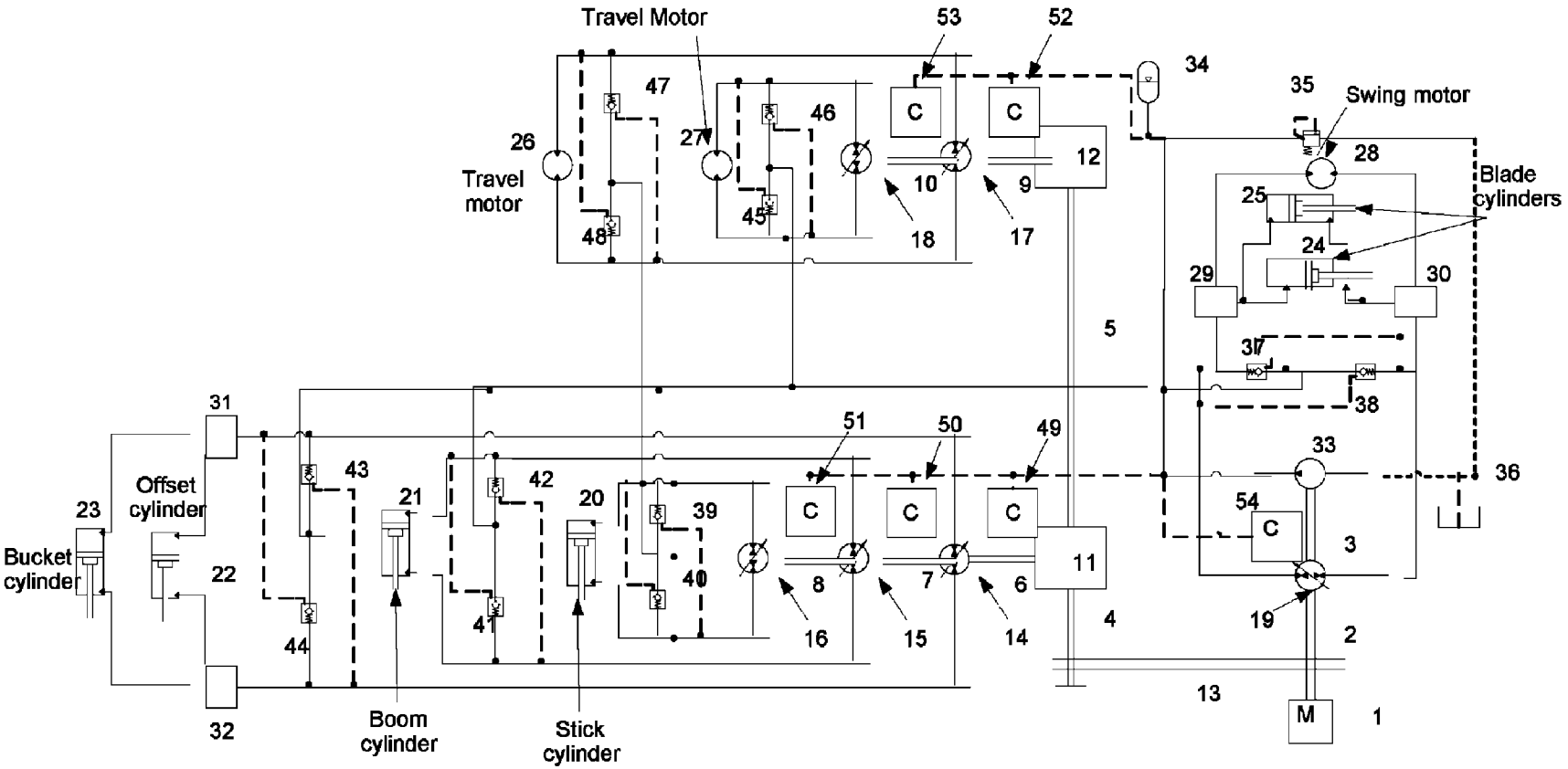
FIG. 2 represents a hydraulic actuation system for controlling functions of the excavator represented in FIG. 1 in accordance with an embodiment of this invention.

FIG. 2 shows a hydraulic actuation system equipped with six pumps 14 through 19 with power sharing capabilities that enable control of eight functions of the excavator 100 represented in FIG. 1, while maintaining independent control of rotary hydraulic drive/travel motors 26 and 27 of the excavator 100 regardless of simultaneous operation of the remaining functions. The pumps 14-19 are represented as variable displacement pumps powered through mechanical connections 2 through 13 from a primary power source 1, for example, an internal combustion engine. The mechanical connections 2-13 can be of any suitable type, for example, drive shafts 2-10 and 13 and gear boxes 11 and 12 that transfer and distribute rotary power from the power source 1 to the pumps 14-19. Controls 49 through 54 of any suitable type are used to control the displacements of the variable displacement pumps 14-19. The flows produced by the pumps 14-19 directly control the operations of the linear actuators (hydraulic cylinders) 20-25 previously identified in reference to FIG. 1, as well as rotary hydraulic drive/travel motors 26 and 27 for the tracks 103 and a rotary hydraulic swing motor 28 for the cabin 101. These linear and rotary actuators 20-28 perform the several functions of the excavator 100, including the operation of the two earthmoving implements of the excavator 100, namely, the blade 104 and the articulating arm 105 (which, as represented in FIG. 1, comprises the boom 106, stick 107 and bucket 108). Pumps 14 and 19 are each represented as controlling one of two different machine functions at any given time, with valves 29 through 32 provided to allow the output of each pump 14 and 19 to be switched between the two different machine functions controlled by that particular pump 14 or 19. As such, the valves 29-32 enable the pumps 14 and 19 to sequentially control multiple different machine functions assigned to them. The hydraulic system of FIG. 2 is represented as further including a hydraulic return system that includes a charge pump 33, accumulator 34, pressure control valve 35, reservoir 36, check valves 37-48, and control valves 49-54, whose functions within the system can be readily appreciated from FIG. 2.

In the configuration shown in FIG. 2, the pump 19 controls the rotary swing motor 28 that performs the swing function of the excavator cab 101, and controls the linear actuators 24 and 25 that operate the excavator blade 104. The valves 29 and 30 enable switching of the pump 19 between control of the swing motor 28 (swing function) and control of the blade actuators (hydraulic cylinders) 24 and 24 (blade function) at any given time. As such, the swing function and the blade function cannot be performed simultaneously. Similarly, the valves 31 and 32 enable switching of the pump 14 between control of the actuator (hydraulic cylinder) 23 that operates the bucket 108 and control of the actuator (hydraulic cylinder) 22 that controls the offset function of the articulating arm 105. As such, motion of the bucket 108 (with the actuator 23) and offset adjustments (with the actuator 22) cannot be simultaneously performed.

In contrast to the pumps 14 and 19, the pumps 15 and 16 are dedicated to controlling the boom actuator (hydraulic cylinder) 21 and stick actuator (hydraulic cylinder) 20, respectively, and the pumps 17 and 18 as dedicated to controlling the drive/travel motors 26 and 27, respectively (travel function). As such, motion of the boom 106 and stick 107 and travel of the excavator 100 can be performed simultaneously.

As summarized in Table I, alternate configurations to that of FIG. 2 are also possible, where other pairs of functions that do not require simultaneous operation can be performed by one of the pumps 14-16,19, as may be permitted or practical. Analysis of the system of FIG. 2 reveals that for full functionality of the excavator 100, the number of pumps 14-19 should not be reduced below six, because there are six functions that should be capable of being operated simultaneously, namely, the motions of the boom 106, stick 107, bucket 108, cab 101 (swing function), and the left and right tracks 103 (travel function). More particularly the left and right travel functions should be capable of simultaneous operation with the remainder of the functions, and therefore separate and dedicated pumps (17 and 18) are provided for the left and right travel functions.

TABLE 1

| | Boom | Stick | Bucket | Swing | Offset | Blade | Travel L | Travel R |
|---|---|---|---|---|---|---|---|---|
| Option 1 | | | ○ | X | ○ | X | | |
| Option 2 | | ○ | | X | ○ | X | | |

TABLE 1-continued

| | Boom | Stick | Bucket | Swing | Offset | Blade | Travel L | Travel R |
|---|---|---|---|---|---|---|---|---|
| Option 3 | ○ | | | X | ○ | X | | |
| Option 4 | | | X | ○ | ○ | X | | |
| Option 5 | | ○ | X | | ○ | X | | |
| Option 6 | ○ | | X | | ○ | X | | |
| Option 7 | | X | | ○ | ○ | X | | |
| Option 8 | | X | ○ | | ○ | X | | |
| Option 9 | ○ | X | | | ○ | X | | |
| Option 10 | X | | | ○ | ○ | X | | |
| Option 11 | X | | ○ | | ○ | X | | |
| Option 12 | X | ○ | | | ○ | X | | |

Possible arrangements for implementing switching functions for two of six pumps while maintaining independent control of the travel functions are shown in Table 1, in which functions with an "o" represent two functions controlled by a single pump and those labeled with an "x" represent two functions sharing a different single pump, while those with no label do not share a pump but have one pump for its function. Option 1 is believed to represent the preferred solution for the excavator 100 for the following reasons. The swing function (performed by the swing motor 28) often, though not necessarily, has lower flow rate requirements than the boom, stick, or bucket functions (performed by the actuators 21, 20 and 23, respectively). Thus, the flow losses introduced by the switching valves (29 and 30) will be lower in the swing function than in the boom, stick or bucket functions. Sharing the bucket and the offset functions (performed by the actuators 23 and 22, respectively) allows control of the boom 106 and stick 107 during the operation of the offset function, giving the most control possible of the excavator mechanical arm 105 during operation of the offset function. It is not desirable that the swing and offset functions (performed by the swing motor 28 and actuator 22, respectively) share a pump because they both control the angular orientation of the mechanical arm 105, and simultaneous operation of these functions is often desirable.

In all arrangements, the left and right travel functions (performed by the motors 26 and 27) are always independent of the other six (they never share a pump) to allow the excavator 100 full control while driving. While displacement control of the travel functions as shown in FIG. 2 is desirable, other control methods could be used, such as control valves, and the motors 26 and 27 could be electric motors or other types of motors that can be or must be controlled by other than variable displacement pumps. It should also be noted that the invention can be applied to wheeled excavators as well as the track-type excavator represented in FIG. 1.

A pump-controlled (displacement-controlled) hydraulic system as described above eliminates the need for control valves and the large energy losses existing with throttle-based control methods. This consequently reduces the heat generated by the system and thus reduces the cooling requirements of the system. The pump-controlled system also allows energy saving through the recovery of energy through any of the variable displacement pumps 14-19 and redistributing the recovered energy to power simultaneous operations of other functions. Furthermore, the system architecture is simplified, requiring fewer components, generating fewer potential leak points in the system, and minimizing the number of pumps required to have full control of the system using pump-controlled actuation. Finally, the system minimizes the number of pumps required for a pump-controlled multi-function machine while maintaining independent control of the travel motors, for example, a hydrostatic drive.

Other aspects and advantages of this invention will be better appreciated from further reference to FIG. 2.

While the invention has been described in terms of a specific embodiment, it is apparent that other forms could be adopted by one skilled in the art. For example, the invention is applicable to a wide variety of multi-function machines with one or more implements whose movements are controlled by multiple actuators. Furthermore, the functions of individual components of the system could be performed by components of different construction but capable of a similar (though not necessarily equivalent) function. Accordingly, it should be understood that the invention is not limited to the specific embodiment illustrated in FIGS. 1 and 2. Instead, the scope of the invention is to be limited only by the following claims.

The invention claimed is:

1. A displacement-controlled hydraulic system installed on a multi-function machine having means for propelling the machine, at least a first implement, and multiple actuators that perform multiple functions of the machine, the multiple actuators comprising first actuators that control the first implement and second actuators that control the means for propelling the machine, the hydraulic system comprising:

multiple pumps having outputs that control the first actuators or control the first actuators and the second actuators; and valve means for switching the output of at least one of the pumps between two of the multiple actuators to sequentially control a corresponding two functions of the multiple functions performed thereby, and the valve means does not switch the outputs of the pumps to control the second actuators in combination with any of the first actuators.

2. The displacement-controlled hydraulic system according to claim 1, wherein the second actuators comprise first and second rotary actuators.

3. The displacement-controlled hydraulic system according to claim 2, wherein a first of the pumps controls only the first rotary actuator and a second of the pumps controls only the second rotary actuator.

4. The displacement-controlled hydraulic system according to claim 1, wherein the first implement comprises an articulating arm and an attachment thereto.

5. The displacement-controlled hydraulic system according to claim 1, further comprising a second implement.

6. The displacement-controlled hydraulic system according to claim 5, wherein the second implement comprises a blade.

7. The displacement-controlled hydraulic system according to claim 1, wherein the first implement comprises an attachment on an articulating arm comprising a boom and a stick, the machine further comprises a second implement comprising a blade, the multiple actuators comprise third actuators that control the blade, and the first actuators control motion of the boom, motion of the stick, motion of the attachment, and offset motion of the articulating arm.

8. The displacement-controlled hydraulic system according to claim 7, wherein the first, second, and third actuators are chosen from the group consisting of rotary hydraulic actuators and linear hydraulic actuators.

9. The displacement-controlled hydraulic system according to claim 7, wherein the machine further comprises a cab and at least a fourth actuator that performs a swing motion of the cab.

10. The displacement-controlled hydraulic system according to claim 9, wherein the first and third actuators are linear hydraulic cylinders that control the motions of the boom, the stick, the attachment, the blade, and the articulating arm, and the second and fourth actuators are rotary hydraulic motors that control the motions of the means for propelling the machine and the swing motion of the cab.

11. The displacement-controlled hydraulic system according to claim 10, wherein a first of the rotary hydraulic motors that control the motion of the propelling the machine is controlled by a first of the pumps and a second of the rotary hydraulic motors that control the motion of the means for propelling the machine is controlled by a second of the pumps.

12. The displacement-controlled hydraulic system according to claim 10, wherein the system comprises six of the pumps, a first of the six pumps controls only the motion of the boom, a second of the six pumps controls only the motion of the stick, a third of the six pumps sequentially controls the motion of the attachment and the offset motion of the articulating arm, a fourth of the six pumps sequentially controls the motion of the blade and the swing motion of the cab, and a fifth and sixth of the six pumps control only the means for propelling the machine.

13. The displacement-controlled hydraulic system according to claim 1, wherein:

the first implement comprises an attachment on an articulating arm comprising a boom and a stick;

the machine further comprises a cab and a second implement comprising a blade;

the first actuators control motion of the boom, motion of the stick, motion of the attachment, and offset motion of the articulating arm;

the multiple actuators further comprise third actuators that control motion of the blade;

the multiple actuators further comprise at least a fourth actuator that performs a swing motion of the cab; and the motions of the boom, the stick, the attachment, the articulating arm, the blade, and the cab are controlled by sharing the pumps in accordance with one of the following options:

the motion of the attachment and the motion of the offset are controlled by a first of the pumps, the swing motion and the motion of the blade are controlled by a second of the pumps, the motion of the boom is controlled by a third of the pumps, and the motion of the stick is controlled by a fourth of the pumps; or the motion of the stick and the motion of the offset are controlled by a first of the pumps, the swing motion and the motion of the blade are controlled by a second of the pumps, the motion of the boom is controlled by a third of the pumps, and the motion of the bucket is controlled by a fourth of the pumps; or the motion of the boom and the motion of the offset are controlled by a first of the pumps, the swing motion and the motion of the blade are controlled by a second of the pumps, the motion of the stick is controlled by a third of the pumps, and the motion of the bucket is controlled by a fourth of the pumps; or the swing motion and the motion of the offset are controlled by a first of the pumps, the motion of the bucket and the motion of the blade are controlled by a second of the pumps, the motion of the boom is controlled by a third of the pumps, and the motion of the stick is controlled by a fourth of the pumps; or the motion of the stick and the motion of the offset are controlled by a first of the pumps, the motion of the bucket and the motion of the blade are controlled by a second of the pumps, the motion of the boom is controlled by a third of the pumps, and the swing motion is controlled by a fourth of the pumps; or the motion of the boom and the motion of the offset are controlled by a first of the pumps, the motion of the bucket and the motion of the blade are controlled by a second of the pumps, the motion of the stick is controlled by a third of the pumps, and the swing motion is controlled by a fourth of the pumps; or the swing motion and the motion of the offset are controlled by a first of the pumps, the motion of the stick and the motion of the blade are controlled by a second of the pumps, the motion of the boom is controlled by a third of the pumps, and the motion of the bucket is controlled by a fourth of the pumps; or the motion of the bucket and the motion of the offset are controlled by a first of the pumps, the motion of the stick and the motion of the blade are controlled by a second of the pumps, the motion of the boom is controlled by a third of the pumps, and the swing motion is controlled by a fourth of the pumps; or the motion of the boom and the motion of the offset are controlled by a first of the pumps, the motion of the stick and the motion of the blade are controlled by a second of the pumps, the motion of the bucket is controlled by a third of the pumps, and the swing motion is controlled by a fourth of the pumps; or the swing motion and the motion of the offset are controlled by a first of the pumps, the motion of the boom and the motion of the blade are controlled by a second of the pumps, the motion of the stick is controlled by a third of the pumps, and the motion of the bucket is controlled by a fourth of the pumps; or the motion of the boom and the motion of the offset are controlled by a first of the pumps, the motion of the stick and the motion of the blade are controlled by a second of the pumps, the motion of the stick is controlled by a third of the pumps, and the swing motion is controlled by a fourth of the pumps; or the motion of the stick and the motion of the offset are controlled by a first of the pumps, the motion of the boom and the motion of the blade are controlled by a second of the pumps, the motion of the bucket is controlled by a third of the pumps, and the swing motion is controlled by a fourth of the pumps.

14. The displacement-controlled hydraulic system according to claim 1, wherein the machine is an excavator.

15. A displacement-controlled hydraulic system for a multi-function machine, the hydraulic system comprising:

first and second travel actuators for propelling the machine, the first travel actuator associated with a first side of the machine and the second travel actuator associated with an oppositely-disposed second side of the machine;

a plurality of function actuators for performing other functions of the machine;

a plurality of pumps having outputs, the plurality of pumps including a first pump wherein the output thereof is dedicated for powering the first travel actuator, a second pump wherein the output thereof is dedicated for powering the second travel actuator, and multiple pumps wherein the outputs thereof power the function actuators; and means for switching the output of at least one of the multiple pumps between two or more of the function actuators to sequentially control two or more functions of the other functions of the machine.

16. An excavator comprising:

means for propelling the excavator;

at least a first earthmoving implement;

multiple actuators that perform multiple functions of the excavator, the multiple actuators comprising first actuators that control the first earthmoving implement and second actuators that control the means for propelling the excavator;

a system for controlling and actuating the multiple actuators, the system comprising multiple pumps having outputs that control the first actuators or control the first actuators and the second actuators; and valve means for switching the output of at least one of the pumps between two of the multiple actuators to sequentially control a corresponding two functions of the multiple functions performed thereby, and the valve means does not switch the outputs of the pumps to control the second actuators in combination with any of the first actuators.

17. The excavator according to claim 16, wherein the second actuators comprise first and second rotary actuators.

18. The excavator according to claim 17, wherein a first of the pumps controls only the first rotary actuator and a second of the pumps controls only the second rotary actuator.

19. The excavator according to claim 16, wherein the first earthmoving implement comprises an articulating arm and an attachment thereto.

20. The excavator according to claim 16, further comprising a second earthmoving implement.

21. The excavator according to claim 20, wherein the second earthmoving implement comprises a blade.

22. The excavator according to claim 16, wherein the first earthmoving implement comprises an attachment on an articulating arm comprising a boom and a stick, the excavator further comprises a second earthmoving implement comprising a blade, the multiple actuators comprise third actuators that control the blade, and the first actuators control motion of the boom, motion of the stick, motion of the attachment, and offset motion of the articulating arm.

23. The excavator according to claim 22, wherein the first, second, and third actuators are chosen from the group consisting of rotary or linear hydraulic actuators.

24. The excavator according to claim 22, wherein the excavator further comprises a cab and at least a fourth actuator that performs a swing motion of the cab.

25. The excavator according to claim 24, wherein the first and third actuators are linear hydraulic cylinders that control the motions of the boom, the stick, the attachment, the blade, and the articulating arm, and the second and fourth actuators are rotary hydraulic motors that control the motions of the means for propelling the excavator and the swing motion of the cab.

26. The excavator according to claim 25, wherein a first of the rotary hydraulic motors that control the motion of the means for propelling the excavator is controlled by a first of the pumps and a second of the rotary hydraulic motors that control the motion of the propelling means for propelling the excavator is controlled by a second of the pumps.

27. The excavator according to claim 25, wherein the system comprises six of the pumps, a first of the six pumps controls only the motion of the boom, a second of the six pumps controls only the motion of the stick, a third of the six pumps sequentially controls the motion of the attachment and the offset motion of the articulating arm, a fourth of the six pumps sequentially controls the motion of the blade and the swing motion of the cab, and a fifth and sixth of the six pumps control only the means for propelling the excavator.

28. The excavator according to claim 16, wherein:

the first earthmoving implement comprises an attachment on an articulating arm comprising a boom and a stick;

the excavator further comprises a cab and a second earthmoving implement comprising a blade;

the first actuators control motion of the boom, motion of the stick, motion of the attachment, and offset motion of the articulating arm;

the multiple actuators further comprise third actuators that control motion of the blade;

the multiple actuators further comprise at least a fourth actuator that performs a swing motion of the cab; and the motions of the boom, the stick, the attachment, the articulating arm, the blade, and the cab are controlled by sharing the pumps in accordance with one of the following options:

the motion of the attachment and the motion of the offset are controlled by a first of the pumps, the swing motion and the motion of the blade are controlled by a second of the pumps, the motion of the boom is controlled by a third of the pumps, and the motion of the stick is controlled by a fourth of the pumps; or the motion of the stick and the motion of the offset are controlled by a first of the pumps, the swing motion and the motion of the blade are controlled by a second of the pumps, the motion of the boom is controlled by a third of the pumps, and the motion of the bucket is controlled by a fourth of the pumps; or the motion of the boom and the motion of the offset are controlled by a first of the pumps, the swing motion and the motion of the blade are controlled by a second of the pumps, the motion of the stick is controlled by a third of the pumps, and the motion of the bucket is controlled by a fourth of the pumps; or the swing motion and the motion of the offset are controlled by a first of the pumps, the motion of the bucket and the motion of the blade are controlled by a second of the pumps, the motion of the boom is controlled by a third of the pumps, and the motion of the stick is controlled by a fourth of the pumps; or the motion of the stick and the motion of the offset are controlled by a first of the pumps, the motion of the bucket and the motion of the blade are controlled by a second of the pumps, the motion of the boom is controlled by a third of the pumps, and the swing motion is controlled by a fourth of the pumps; or the motion of the boom and the motion of the offset are controlled by a first of the pumps, the motion of the bucket and the motion of the blade are controlled by a second of the pumps, the motion of the stick is controlled by a third of the pumps, and the swing motion is controlled by a fourth of the pumps; or the swing motion and the motion of the offset are controlled by a first of the pumps, the motion of the stick and the motion of the blade are controlled by a second of the pumps, the motion of the boom is controlled by a third of the pumps, and the motion of the bucket is controlled by a fourth of the pumps; or the motion of the bucket and the motion of the offset are controlled by a first of the pumps, the motion of the stick and the motion of the blade are controlled by a second of the pumps, the motion of the boom is controlled by a third of the pumps, and the swing motion is controlled by a fourth of the pumps; or the motion of the boom and the motion of the offset are controlled by a first of the pumps, the motion of the stick and the motion of the blade are controlled by a second of the pumps, the motion of the bucket is controlled by a third of the pumps, and the swing motion is controlled by a fourth of the pumps; or the swing motion and the motion of the offset are controlled by a first of the pumps, the motion of the boom and the motion of the blade are controlled by a second of the pumps, the motion of the stick is controlled by a third of the pumps, and the motion of the bucket is controlled by a fourth of the pumps; or the motion of the boom and the motion of the offset are controlled by a first of the pumps, the motion of the stick and the motion of the blade are controlled by a second of the pumps, the motion of the stick is controlled by a third of the pumps, and the swing motion is controlled by a fourth of the pumps; or the motion of the stick and the motion of the offset are controlled by a first of the pumps, the motion of the boom and the motion of the blade are controlled by a second of the pumps, the motion of the bucket is controlled by a third of the pumps, and the swing motion is controlled by a fourth of the pumps.

* * * * *